US005665009A

United States Patent [19]

Sherwood

[11] Patent Number: 5,665,009

[45] **Date of Patent: *Sep. 9, 1997**

[54] CORRELATED SET OF GOLF CLUB IRONS

[76] Inventor: Brad L. Sherwood, East 511 Eastview Dr., Spokane, Wash. 99208

[ * ] Notice: The term of this patent shall not extend beyond the expiration date of Pat. No. 5,388,826.

[21] Appl. No.: 695,001

[22] Filed: Aug. 8, 1996

Related U.S. Application Data

[63] Continuation of PCT/US90/01864, Feb. 13, 1995.

[51] Int. Cl.[6] ..... A63B 53/00

[52] U.S. Cl. ..... 473/291

[58] Field of Search ..... 473/290, 291

[56] References Cited

U.S. PATENT DOCUMENTS

| | | | |
|---|---|---|---|
| 1,128,288 | 2/1915 | Churchill . | |
| 1,671,956 | 5/1928 | Sime . | |
| 2,007,377 | 7/1935 | Link . | |
| 2,254,528 | 9/1941 | Hoare | 273/77 |
| 3,059,926 | 10/1962 | Johnstone | 273/77 |
| 3,655,188 | 4/1972 | Solheim | 273/77 |
| 3,722,887 | 3/1973 | Cochran et al. | 273/77 |
| 3,845,955 | 11/1974 | Solheim | 273/77 |
| 3,897,065 | 7/1975 | Solheim | 273/167 |
| 3,984,103 | 10/1976 | Nix | 273/77 |
| 4,147,349 | 4/1979 | Jeghers | 273/77 |
| 4,247,105 | 1/1981 | Jeghers | 273/77 |
| 4,512,577 | 4/1985 | Solheim | 278/77 |
| 4,621,813 | 11/1986 | Solheim | 273/77 |
| 4,784,390 | 11/1988 | Horgen | 273/77 |
| 4,802,672 | 2/1989 | Long | 273/77 |
| 4,840,380 | 6/1989 | Kajita et al. | 273/77 |
| 4,854,581 | 8/1989 | Long | 273/77 |
| 4,923,197 | 5/1990 | Schact | 273/77 |
| 4,971,321 | 11/1990 | Davis | 273/77 |
| 4,995,609 | 2/1991 | Parente et al. | 273/80.2 |
| 5,056,788 | 10/1991 | Katayama | 273/77 |
| 5,067,711 | 11/1991 | Parente et al. | 273/77 |
| 5,120,062 | 6/1992 | Schele et al. | 273/167 |
| 5,160,137 | 11/1992 | Katayama | 273/77 |
| 5,193,805 | 3/1993 | Solheim | 273/77 |
| 5,222,734 | 6/1993 | Parente et al. | 273/80.2 |
| 5,224,705 | 7/1993 | Schele et al. | 273/77 |
| 5,228,688 | 7/1993 | Davis | 273/77 |
| 5,388,826 | 2/1995 | Sherwood | 273/77 |
| 5,480,145 | 1/1996 | Sherwood | 473/291 |

FOREIGN PATENT DOCUMENTS

| | | |
|---|---|---|
| 2842245 | 4/1979 | Germany . |
| 2200558 | 8/1988 | United Kingdom . |

*Primary Examiner*—William H. Grieb

*Attorney, Agent, or Firm*—Wells, St. John, Roberts, Gregory & Matkin P.S.

[57] ABSTRACT

In one aspect, a correlated set of individually numbered golf club iron heads progresses from a high numbered head to a low numbered head. Individual heads have a front striking face, a rear face, a sole, a toe, a heel and a hosel. The front striking faces of heads within the set individually have a total planar area defining a progressively decreasing loft angle in going from the high numbered head to the low numbered head. For at least two chosen pairs of heads within the set, the striking face total planar area of individual heads within each chosen pair increases in size in going from the higher numbered head to the lower numbered head in the pair. In another aspect, a correlated set of individually numbered golf club iron heads comprises at least a 3-iron head, a 4-iron head and a 5-iron head. The hosel is provided relative to the sole to provide a different and increasing lie angle in sequentially progressing from the 3-iron head to the 5-iron head. The heads within the set define a 3-iron and 4-iron pair of heads and a 4-iron and 5-iron pair of heads. The sum of the differences between the lie angles in the 3-iron/4-iron pair and between the lie angles in the 4-iron/5-iron pair are less than or equal to about 1.0°.

23 Claims, 8 Drawing Sheets

CORRELATED SET OF GOLF CLUB IRONS

RELATED PATENT DATA

This patent resulted from a continuation application under 37 CFR §1.62 of prior International Application No. PCT/US90/01864, filed on Feb. 13, 1995, entitled "Correlated Set of Golf Club Irons" listing the inventor as Brad Sherwood, and ultimately has priority to U.S. patent application Ser. No. 08/196,387, which is now U.S. Pat. No. 5,388,826.

1. Technical Field

This invention relates to sets of golf club irons.

2. Background Art

A complete set of golf club irons typically includes a set of eleven irons numbered from 2 (long) through 9 (short), a pitching wedge (PW) and a sand wedge (SW). A 1-iron is also sometimes included in the set, although the average golf club does not include a 1-iron due to difficulty in using the club. Each iron comprises a head including a hosel and a shaft which is attached to the head by fitting the shaft into a bore of the hosel. The hosel is integrally formed as part of the head. The head also includes a heel, a bottom sole, a toe, a planar striking face, and a back side.

The typical eleven irons of a golf club set have varying degrees of loft angle. The loft angle of an iron is the angle between a vertical plane, which includes the shaft, and the plane of the striking face of the iron. The loft angle effects how much loft is imparted to the ball when it is struck by the tilted, striking face.

Longer-hitting irons (i.e., #2, #3, #4) have progressively longer golf club shafts than the shorter-hitting irons (i.e., #5, #6, #7, #8, #9, PW, SW). Typically, the length of the golf club shaft progressively increases in length from PW through the 2-iron. Further, it is a typical design criteria that each golf club within a set have the same substantially identical swing weight. As the volume of shaft is different for each club due to varying length, the mass of the club head is varied inversely to the length of the shaft such that a substantially constant swing weight is achieved for each club within a complete set. Accordingly, typically the PW head is heaviest and the 2-iron head is lightest within a given set 2-iron through PW. Such is typically provided for in the prior art by making larger hitting face area short irons, and comparatively smaller size hitting face area in the longer irons. The hitting area progressively increases in going from the long irons to the short irons within the typical prior art set.

Golf clubs within a complete set also typically have varying degrees of lie angle throughout the complete set. The lie angle of an iron is the angle between the shaft and the ground (horizontal plane) when the tangent to the sole directly under the head's center of mass is in a horizontal plane and when the shaft lies in a vertical plane. Varying lie angles are provided to accommodate the different length of shafts throughout a complete set of irons. For example, when a golfer addresses the ball with a club, he/she will be standing further away from the ball when hitting with a 2-iron than he/she will when hitting with, for example, a 9-iron, due to the increased length of the 2-iron shaft versus the 9-iron shaft. It is a general prior art goal that the sole of a golf club head lay flat against the turf when the ball is addressed by the golfer. Accordingly, the hosel angles downwardly from vertical for the longer irons than is required for the shorter irons.

Dynamics of the shaft during swinging the golf club can, however, have an adverse effect with respect to the above relationship. Specifically, the shaft of a longer distance iron (i.e., #2, #3, #4 and #5) creates more club head speed and is more flexible due to the longer length of the shaft. This actually results in a curving or banana-like bending of the shaft slightly inward and down at impact, thus forcing the toe of the club slightly down and into the ground, as opposed to passing parallel relative thereto. Thus a golf club head, especially of a long iron, leaves the toe vulnerable even for a correct swing to being pulled downwardly open by the ground at ball impact. This will tend to cause the ball to fade right or slice right, for a right-handed golfer. The average golfer has a considerably more difficult time in consistently hitting the longer distance irons than he/she does hitting the shorter distance irons because of these dynamics in controlling a longer shaft.

There are common or standard lie angles provided for a golf club head throughout a complete set for an average height golfer. A prior art example is shown in Table 1 below, with the numbers referring to the angle upward from horizontal.

TABLE 1

| | Prior Art Lie Angle (Degrees) |
|---|---|
| #2 | 58 |
| #3 | 59 |
| #4 | 60 |
| #5 | 61 |
| #6 | 62 |
| #7 | 62.5 |
| #8 | 63 |
| #9 | 64 |
| PW | 65 |
| SW | 66 |

To accommodate different height golfers, a different average golf club length is used within a given correlated complete set. A variation might also exist for an average height golfer if he/she squats more in their stance versus stands upright. The prior art in accommodating for such varying golfers merely changes this standard angling range a given constant angle through the set. For example if a golfer needs a more upright lie, such as a 2° upright, the prior art heads would typically make all the irons in the given set 2° more upright (i.e., going from 60° for a 2-iron through, say, 67° for the PW with the above scale). However when this is done, the shorter distance irons (i.e., #7, #8, #9 and PW) become too upright. The shorter irons do not create as much club head speed because the shaft length is shorter, which makes them stiffer and decreases the inward and downward flex of the shaft. The golfer will therefore have a tendency with such a set to pull or hook the ball left, for a right-handed golfer. The golfer will also tend to stand very close to the ball to get the sole of the club to lay flat at address, putting the golfer in an awkward and improper position. This becomes especially vivid when, for example, a tall person needs a 4° upright adjustment to get the toe out of the ground on long-distance irons. Such would make the prior art pitching wedge according to the above scale provided at 69° upright, essentially making that club unplayable.

Needs remain in golf club iron head design to better facilitate a golfer's control in hitting with the long irons.

BRIEF DESCRIPTION OF THE DRAWINGS

Preferred embodiments of the invention are described below with reference to the following accompanying drawings.

FIG. 14 is a rear face view of a 2-iron head from a correlated set of iron golf club heads in accordance with the invention.

BEST MODES FOR CARRYING OUT THE INVENTION AND DISCLOSURE OF INVENTION

Figure 1:
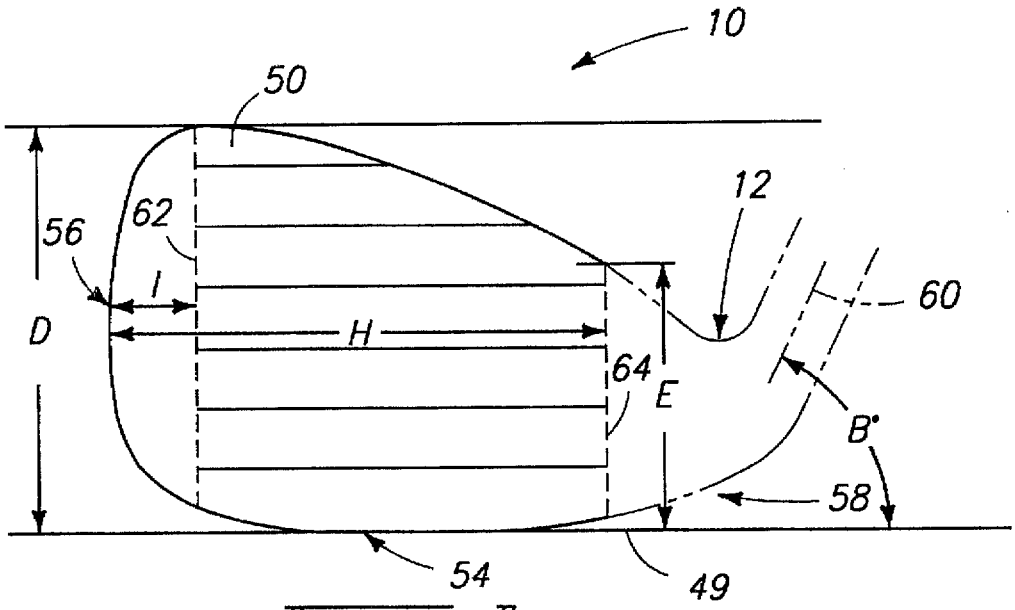
FIG. 1 is a front striking face area view of an iron golf club head from a correlated set of iron heads in accordance with the invention.

In accordance with one aspect of the invention, a correlated set of individually numbered golf club iron heads progresses from a high numbered head to a low numbered head. Individual heads have a front striking face, a rear face, a sole, a toe, a heel and a hosel. The front striking faces of heads within the set individually have a total planar area defining a progressively decreasing loft angle in going from the high numbered head to the low numbered head. For at least two chosen pairs of heads within the set, the striking face total planar area of individual heads within each chosen pair increases in size in going from the higher numbered head to the lower numbered head in the pair.

In accordance with another aspect of the invention, a correlated set of individually numbered golf club iron heads consecutively progresses from a high numbered head to a low numbered head. Individual heads have a front striking face, a rear face, a sole, a toe, a heel and a hosel. The front striking faces of heads within the set individually have a total planar area defining a progressively decreasing loft angle in going from the high numbered head to the low numbered head. The striking face total planar area of individual heads progressively increases in size in going consecutively from the high numbered head to the low numbered head within the set.

In accordance with yet another aspect of the invention, a correlated set of individually numbered golf club iron heads progresses from a high numbered head to a low numbered head. The heads number at least four within the set. Individual heads have a front striking face, a rear face, a sole, a toe, a heel and a hosel. The front striking faces of heads within the set individually have a total planar area defining a progressively decreasing loft angle in going from the high numbered head to the low numbered head. The substantial rear face of the low numbered head within the set has an open cavity volume provided therein. Higher numbered clubs within the set have a respective rear face with an open cavity volume which progressively decreases within the set in going from lower number heads to higher number heads.

In accordance with still a further aspect of the invention, a correlated set of individually numbered golf club iron heads comprises at least a 3-iron head, a 4-iron head and a 5-iron head, with individual heads having a front striking face, a rear face, a sole, a toe, a heel and a hosel. The hosel is provided relative to the sole to provide a different and increasing lie angle in sequentially progressing from the 3-iron head to the 5-iron head. The heads within the set define a 3-iron and 4-iron pair of heads and a 4-iron and 5-iron pair of heads. The sum of the differences between the lie angles in the 3-iron/4-iron pair and between the lie angles in the 4-iron/5-iron pair are less than or equal to about 1.0°.

In accordance with still a further aspect of the invention, a correlated set of individually numbered golf club iron heads includes at least a 2-iron head, a 3-iron head, a 4-iron head, a 5-iron head, a 6-iron head, a 7-iron head, and an 8-iron head, with individual heads having a front striking face, a rear face, a sole, a toe, a heel, a hosel, and a hosel lie angle relative to the sole. The 3-iron head, the 4-iron head, the 5-iron head, the 6-iron head, the 7-iron head have respective lie angles falling between the lie angles of the 2-iron head and the 8-iron head. The difference between the lie angles of the 2-iron head and the 8-iron head is less than or equal to about 3.0°.

In accordance with even a further aspect of the invention, a correlated set of individually numbered golf club iron heads includes at least a 3-iron head, a 4-iron head and a 5-iron head, with individual heads having a front striking face, a rear face, a sole, a toe, a heel and a hosel. The hosel is provided relative to the sole to provide a different and increasing lie angle in sequentially progressing from the 3-iron head to the 5-iron head. The heads within the set define a 3-iron and 4-iron pair of heads and a 4-iron and 5-iron pair of heads. The difference between the lie angles in each of the 3-iron/4-iron and the 4-iron/5-iron pairs is equal to about 0.5°.

A preferred embodiment correlated golf club set in accordance with the invention is first described with reference to FIGS. 1–5. Such show various aspects and dimensional characteristics described further below with respect to a PW, alternately termed a 10-iron, of a preferred set of golf club iron heads. The PW is designated in FIGS. 1–5 generally with numeral 10. Such comprises a front striking face 50, a rear face 52, a sole 54, a toe 56, a heel 58 and a hosel 60. Front striking face 50 defines a total, substantially planar, hitting area starting from where the hosel integrally forms into a planar hitting area. Horizontal scoring lines formed in striking face 50 extend between a toe-end vertical terminus location 62 and a heel-end vertical terminus location 64.

Clubs of the preferred set have substantially the same general shape as that of FIG. 1. FIGS. 6–14 consecutively show rear face views of the 9-iron head through the 2-iron, respectively, of the preferred set. Such respective heads are designated "9" through "2" in the figures, and correspond to the same numbered head within the actual preferred set. Corresponding front striking faces, rear faces, soles, toes, heels and hosels (where shown) are designated with the above respective even number prefixes 50–60, with the club number being added as a suffix in such figures.

Referring specifically to FIGS. 1–4, various dimensions and angles are shown for any given club in the preferred embodiment set as reported in Table 2 below. Dimensions are in millimeters. In FIG. 1, angle "B" is the lie angle. Dimension "E" is the height from a tangent line 49 of the sole to the highest point of the heel-side scoring line terminus. The heel-side scoring line terminus is generally constantly spaced throughout the set from the point where the planar portion of the hitting face starts becoming non-planar as it forms into the hosel, being approximately 6 mm outward therefrom. "H" is the distance from the heel-side scoring line terminus location to the furthest toe portion of the head. "T" is the distance from the toe-side scoring line terminus and furthest toe portion of the head. Dimension "D" is the distance between the sole tangent and the highest-most elevation of the club head.

Figure 2:
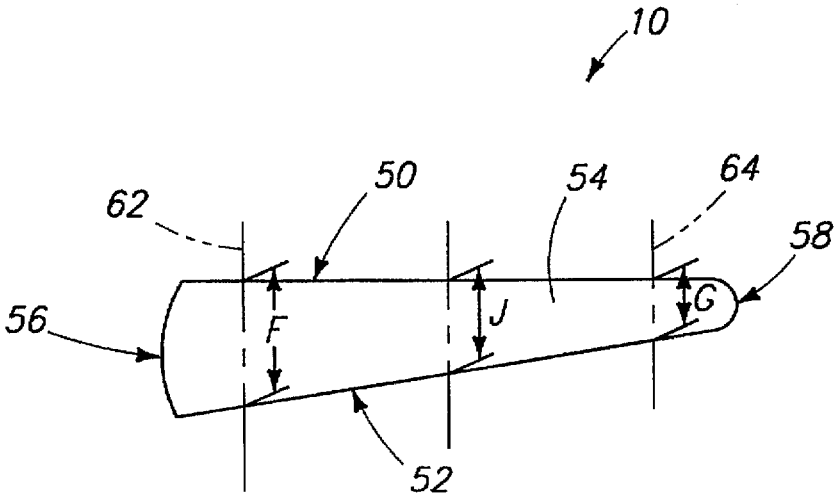
FIG. 2 is a sole view of a the iron golf club head of FIG. 1.

FIG. 2 is an upward sole view of a given club of the set. Dimension "G" is the thickness of the sole at the heel-side scoring line terminus. Dimension "F" is the thickness of the sole at the toe-side scoring line terminus. Dimension "J" is the thickness of the sole at the midpoint between the respective heel-side scoring line terminus and toe-side scoring line terminus.

Figure 3:
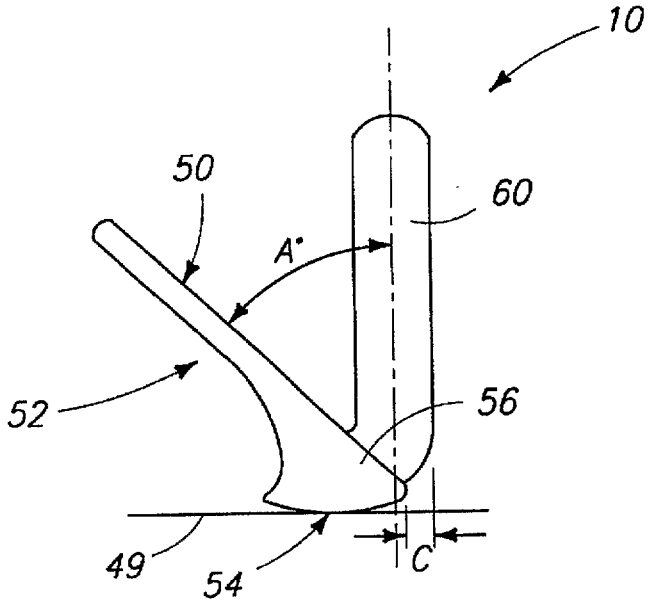
FIG. 3 is a toe-end view of the iron golf club head of FIG. 1.

Referring to FIG. 3, "A" degrees is the loft angle and dimension "C" is the offset between the base of the leading edge of the hitting face and the forward-most portion of the hosel. In the preferred set, offset is constant although varying or progressively changing offsets could of course be provided.

Figure 4:
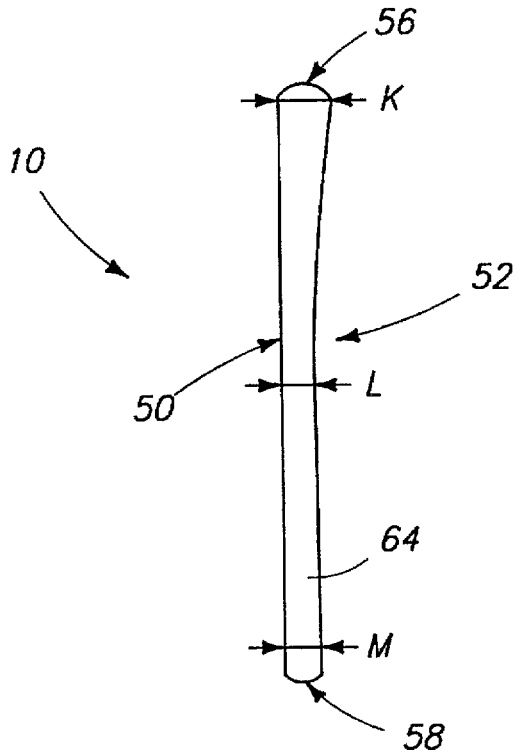
FIG. 4 is a top view of a the iron golf club head of a FIG. 1.

Referring to FIG. 4, "L" is the thickness of the top-most portion of the club at the striking face center between the respective heel-side scoring line terminus and toe-side scoring line terminus. Dimension "K" is the thickness adjacent the toe-most portion of the head. Dimension "M" is the thickness at the top of the head over the heel-most side scoring line terminus.

TABLE 2

| | A | B | C | D | E | F | G | H | I | J | K | L | M |
|---|---|---|---|---|---|---|---|---|---|---|---|---|---|
| #2 | 22.0° | 60.5° | 3.5 | 62.0 | 38.0 | 23.0 | 16.0 | 79.5 | 16.0 | 16.0 | 8.0 | 4.0 | 5.5 |
| #3 | 25.0° | 61.0° | 3.5 | 61.5 | 38.0 | 22.5 | 16.0 | 78.5 | 16.0 | 16.0 | 8.0 | 4.0 | 5.5 |
| #4 | 28.0° | 61.5° | 3.5 | 61.0 | 38.0 | 22.5 | 16.0 | 77.5 | 16.0 | 16.0 | 7.5 | 4.0 | 5.5 |
| #5 | 31.0° | 62.0° | 3.5 | 60.5 | 38.0 | 22.0 | 16.0 | 76.5 | 16.0 | 16.5 | 7.5 | 4.0 | 5.5 |
| #6 | 34.0° | 62.5° | 3.5 | 60.0 | 38.0 | 22.0 | 16.0 | 75.5 | 16.0 | 16.5 | 7.0 | 4.0 | 5.5 |
| #7 | 37.0° | 63.0° | 3.5 | 59.5 | 38.0 | 21.5 | 15.5 | 74.5 | 16.0 | 16.5 | 7.0 | 4.0 | 5.5 |
| #8 | 40.0° | 63.5° | 3.5 | 59.0 | 38.0 | 21.0 | 15.0 | 73.5 | 16.0 | 17.0 | 6.5 | 4.0 | 5.0 |
| #9 | 44.0° | 64.0° | 3.5 | 58.5 | 38.0 | 20.5 | 14.5 | 72.5 | 16.0 | 17.0 | 6.5 | 4.0 | 5.0 |
| PW | 48.0° | 64.0° | 3.5 | 58.5 | 38.0 | 20.0 | 14.0 | 71.5 | 16.0 | 17.0 | 6.5 | 4.0 | 5.0 |

The FIG. 1 view is taken with striking face 50 being vertically oriented, or alternately considered with face 50 being parallel with respect to the plane of the page. Accordingly, hosel 60 would angle significantly out of the page in the direction of the reader in accordance with the left angle of the head.

Figure 5:
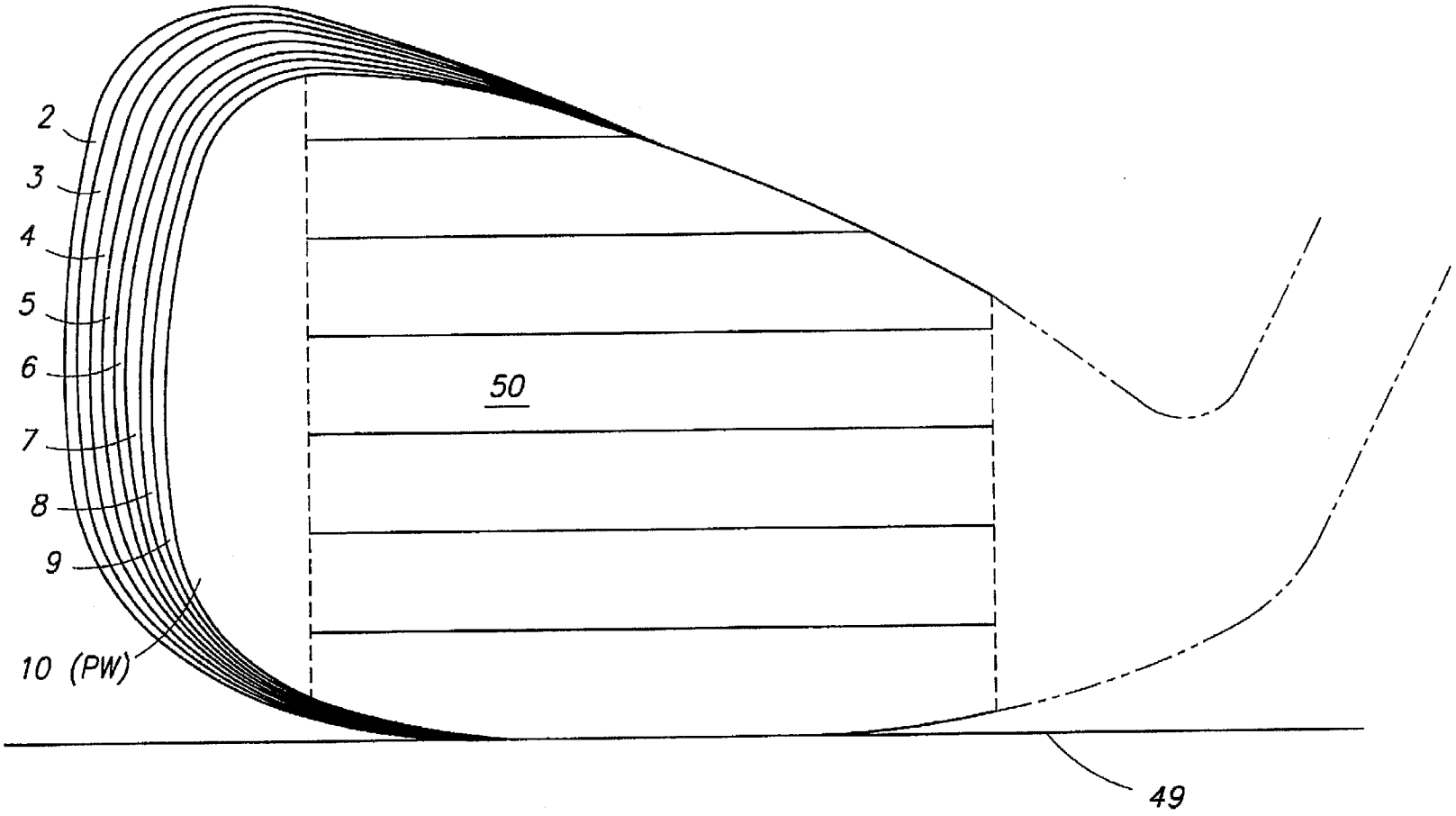
FIG. 5 is a diagrammatic front view of the hitting face area of heads of a correlated set of iron golf club heads in accordance with the invention, with the foreground head being that of FIG. 1.

FIG. 5 diagrammatically illustrates the front striking faces of the above preferred complete correlated set of golf clubs going consecutively from the PW-head through the 2-iron head. FIG. 5 is diagrammatic in the sense that each of the representative club face outlines is of the club as would appear if the respective front striking face area were oriented parallel with respect to the plane of the page, like FIG. 1. As the loft angle in the club set progresses from a minimum from the 2-iron head to a maximum for the PW head, the respective hosels would progressively and increasingly move out of the plane of the page in the direction of the reader in progressing from the 2-iron head through the PW-iron head and in accordance with the respective loft angles. The illustrated hosel of the respective clubs has accordingly been shown in phantom, and is representative of the lie angle of the PW.

As is apparent from FIG. 5, the striking face total planar area of individual heads progressively increases in size in going consecutively from the highest numbered head (PW or 10) to the lowest numbered head (2) within the illustrated set.

Increasing the size of the long irons versus the short irons within a given set provides different and distinct advantages over the prior art. One significant advantage is providing an increasing and larger "sweet" spot within the set for the longer irons. With the longer hitting irons, the club head is further away from the golfer because of the longer and correspondingly more flexible shaft. This makes it more difficult for the golfer to accurately hit the golf ball in comparison to the relative ease of accurately hitting the golf ball with a shorter iron. Having progressively increasing size heads in going to the long irons in accordance with the invention with the provision of a larger sweet spot, gives the golfer a better chance at hitting the ball correctly even though the swing might not be exactly as the golfer intended. Further, the appearance and reality of the larger size golf club head in the longer hitting irons will provide a psychological advantage of giving the golfer more confidence when using such irons.

FIGS. 6–14 show the rear face of the complete preferred set of PW head through 2-iron head, respectively. Such views correspond positionally relative to the front faces of each such head (not viewable in the respective Figures) being parallel with the plane of the page. Accordingly, the respective hosels angle into the plane of the page away from the reader in accordance with the respective loft angle. Looking first to the 2-iron head, FIG. 14, the substantial or majority rear face area has a singular open cavity 21 provided therein. Such singular cavity 21 has an total open cavity volume as is partially evidenced by the shade lines. Each of the progressively increasing numbered heads in the remaining FIGS. 13 through 6, respectively, also has a singular cavity having its own respective open cavity volume. Such are numbered 31 through 101.

Figure 6:
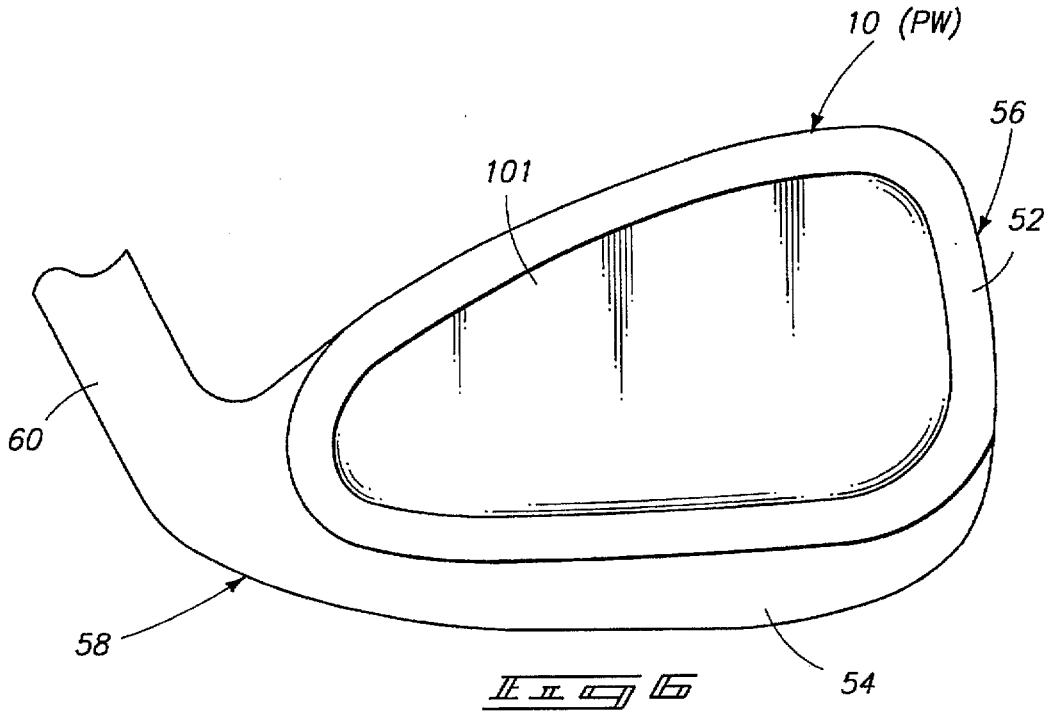
FIG. 6 is a rear face view of the PW iron head of FIG. 1 from a correlated set of iron golf club heads in accordance with the invention.
Figure 7:
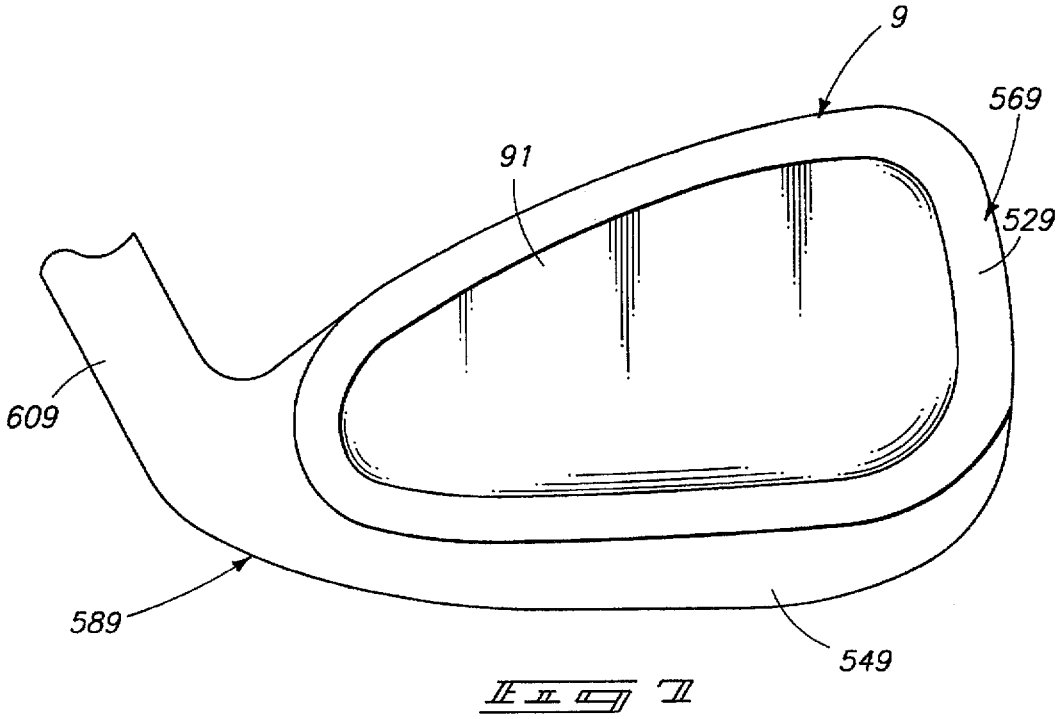
FIG. 7 is a rear face view of a 9-iron head from a correlated set of iron golf club heads in accordance with the invention.
Figure 8:
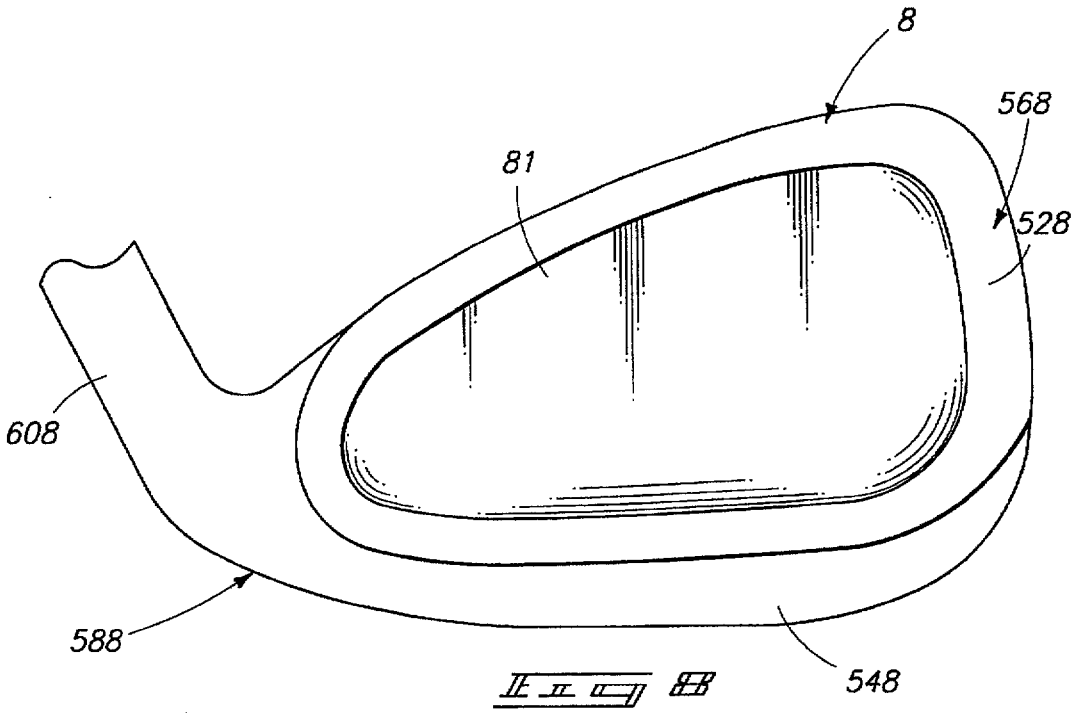
FIG. 8 is a rear face view of a 8-iron head from a correlated set of iron golf club heads in accordance with the invention.
Figure 9:
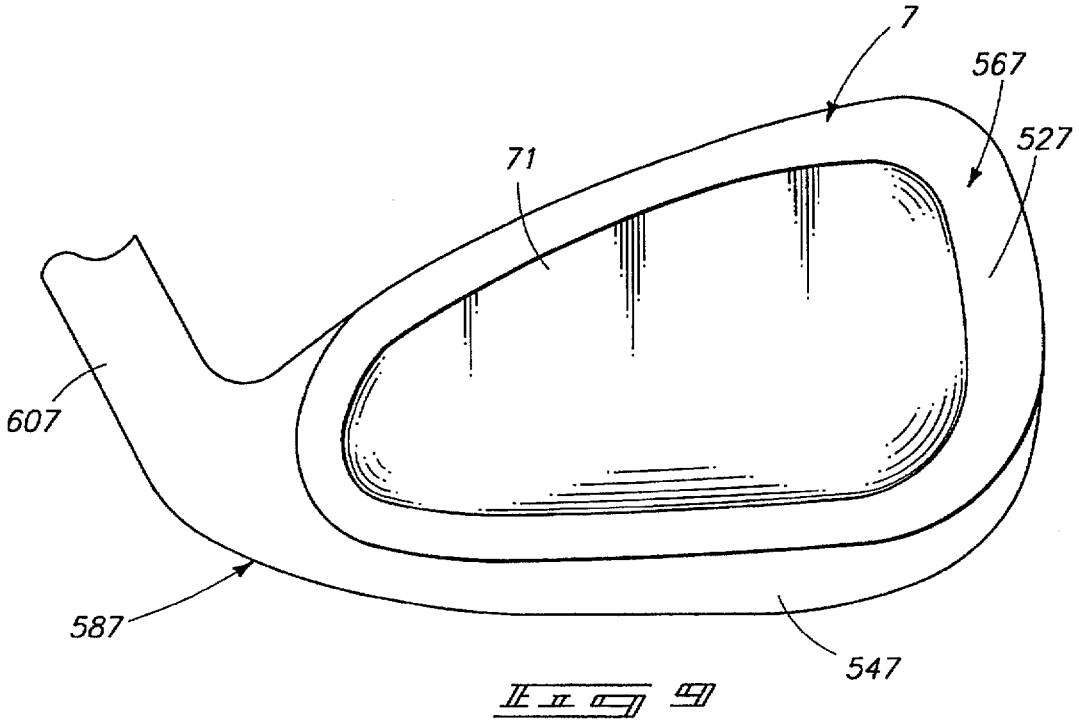
FIG. 9 is a rear face view of a 7-iron head from a correlated set of iron golf club heads in accordance with the invention.
Figure 10:
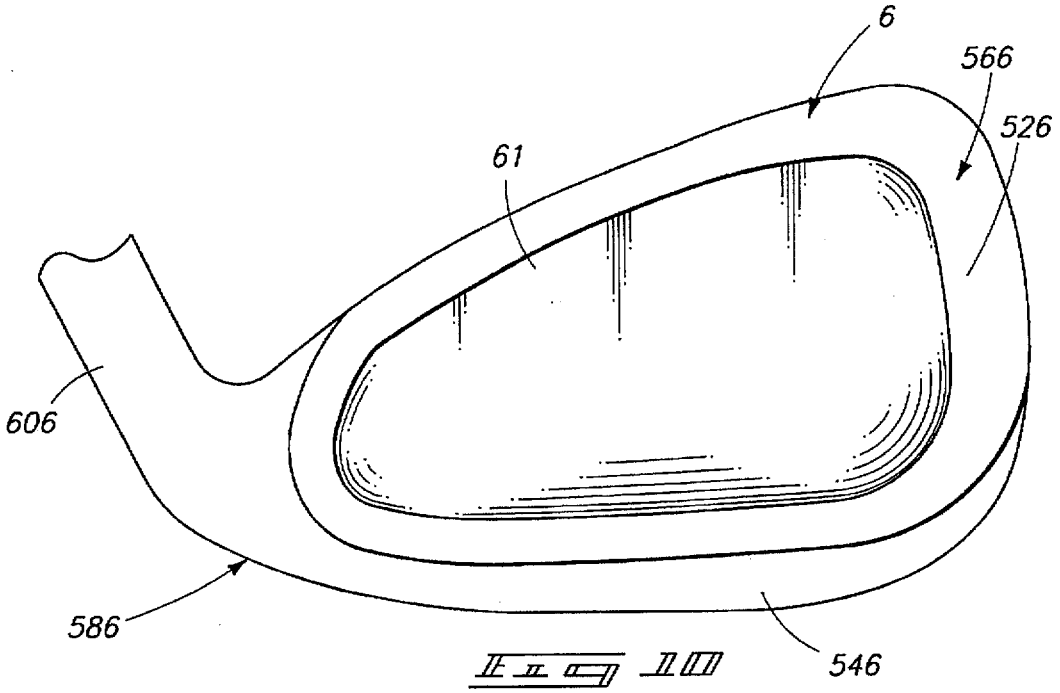
FIG. 10 is a rear face view of a 6-iron head from a correlated set of iron golf club heads in accordance with the invention.
Figure 11:
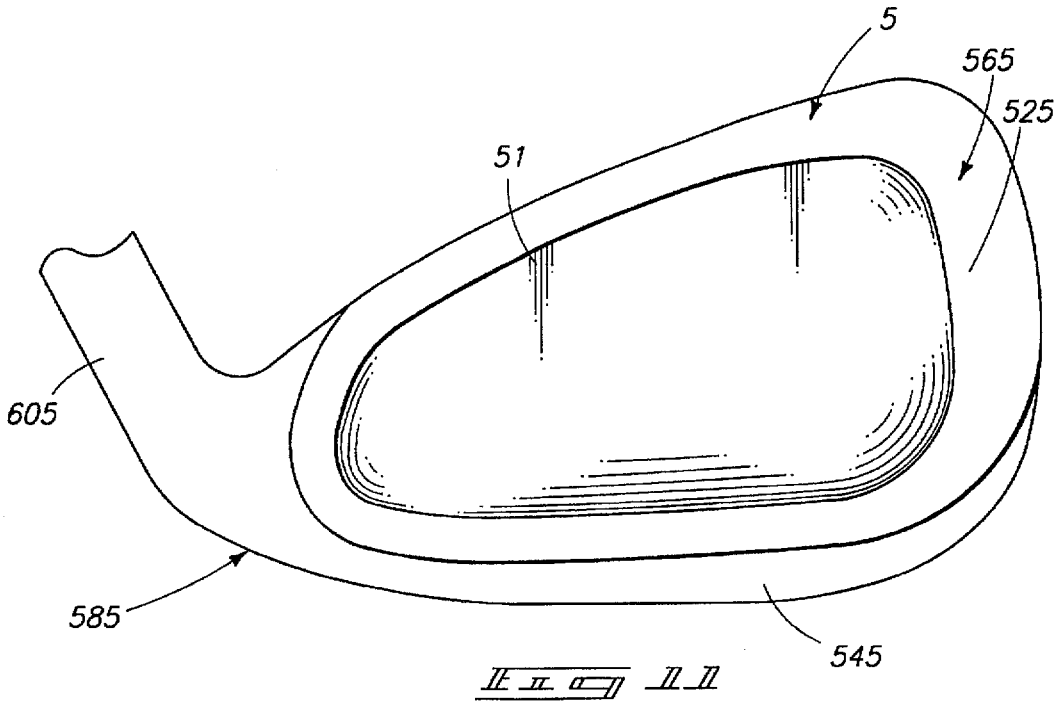
FIG. 11 is a rear face view of a 5-iron head from a correlated set of iron golf club heads in accordance with the invention.
Figure 12:
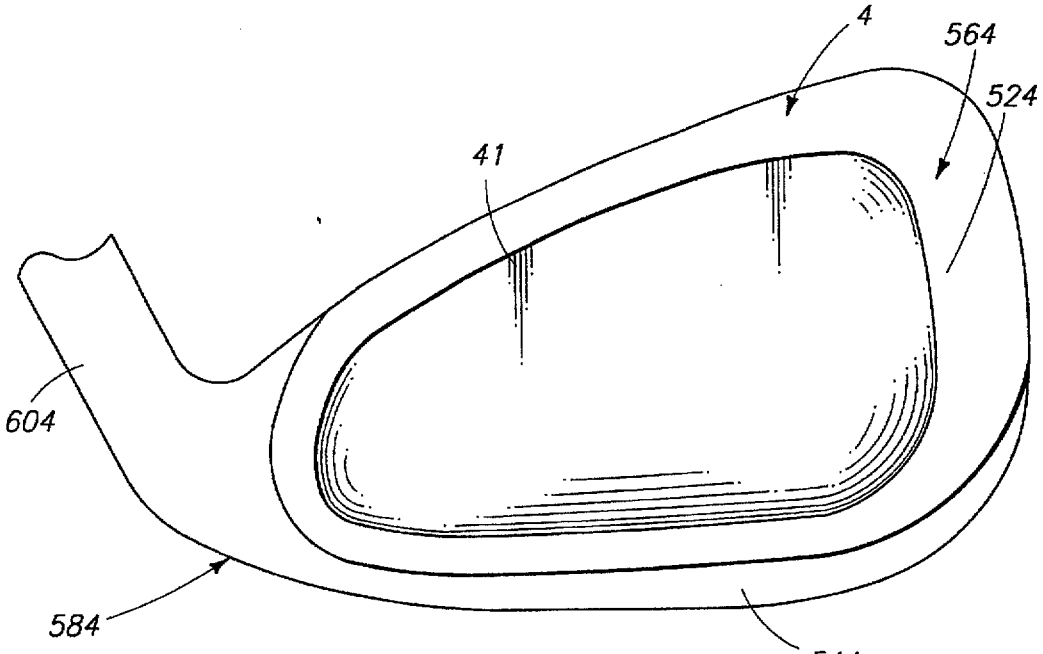
FIG. 12 is a rear face view of a 4-iron head from a correlated set of iron golf club heads in accordance with the invention.
Figure 13:
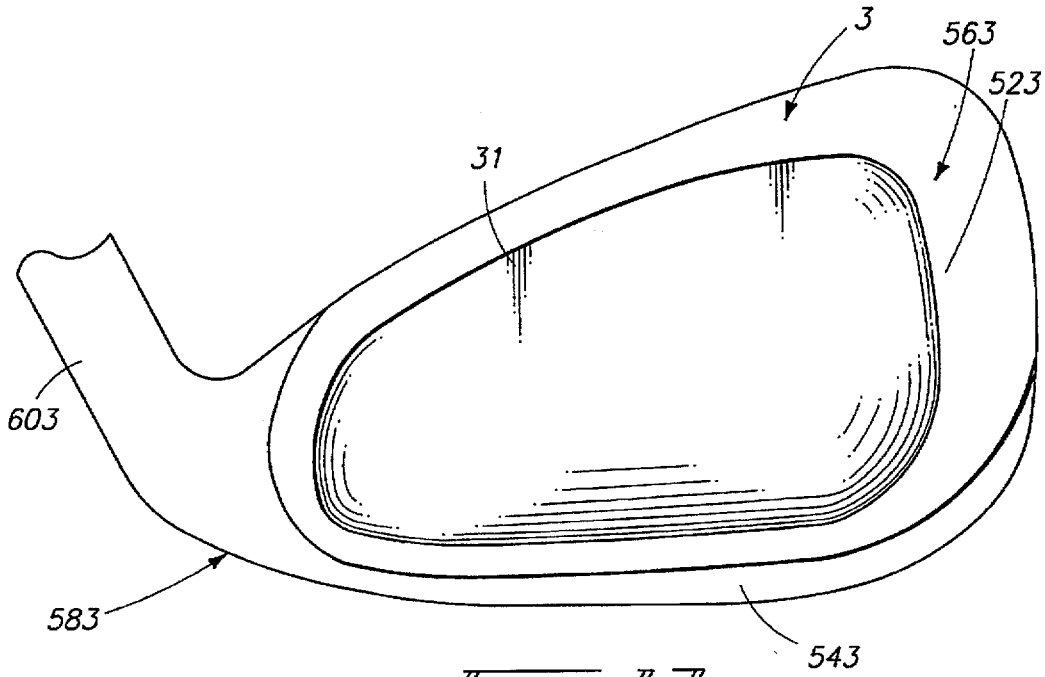
FIG. 13 is a rear face view of a 3-iron head from a correlated set of iron golf club heads in accordance with the invention.
Figure 11:
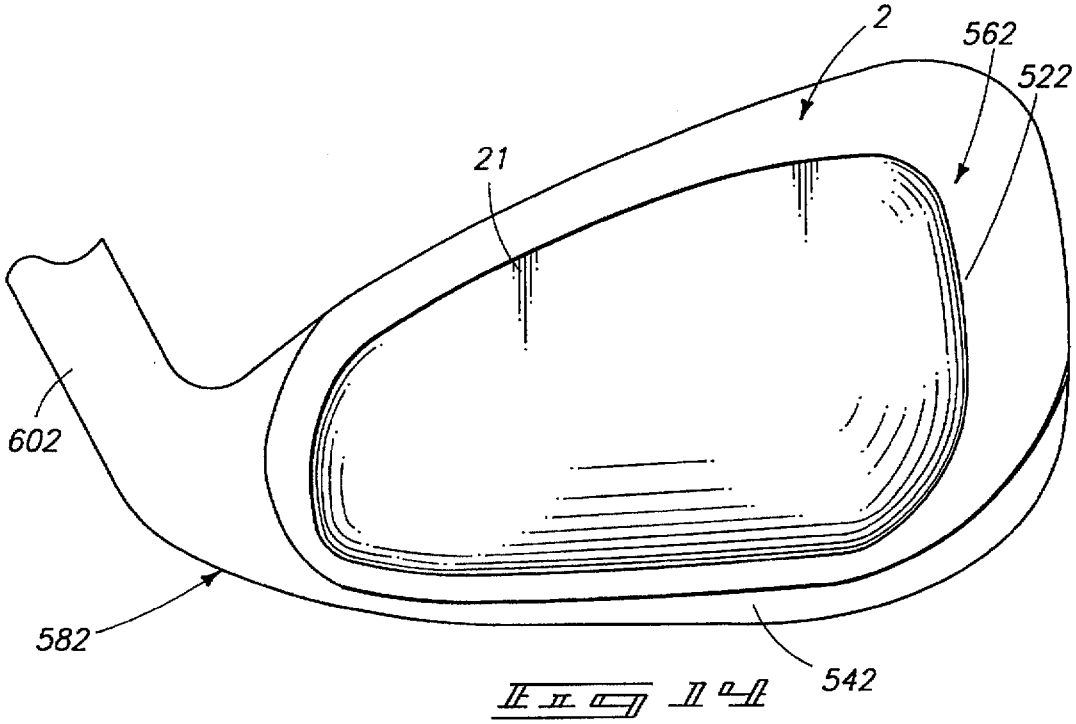

The open cavity volume within the higher numbered clubs within the set decreases in volume in going from the lowest numbered 2-head of FIG. 14 to the highest numbered head 10 (PW) of FIG. 6. Although the relationship is shown with respect to a single cavity in each head, multiple open cavities might be provided in accordance with this aspect of the invention and in the context of a rear face having a majority of its area consumed by cavity area.

The above relationship is understood to be essentially contrary to cavity-backed golf club sets of the prior art. Such prior art clubs again typically have a largest size short iron head and smallest size long iron head. Accordingly, the cavity area and volume of the prior art has the understood opposite relationship of that of the invention, namely progressing from a largest volume cavity in the short iron to a smallest volume cavity in the long iron.

The invention arose principally out of the needs and concerns of golfers associated with playing the long irons. The greatest advantages of the invention are believed to be attainable in the provision and utilization of a complete correlated set of golf clubs (PW through 2-iron) in the consecutive and progressively increasing face area size in one aspect, and in the decreasing cavity volume relationship in another aspect (2-iron through PW). Nevertheless, advantages and unobvious novelty is seen with respect to utilization of smaller subsets of clubs within a larger set where the progression might not occur every consecutive club within the overall set or within a sub-set.

By way of example only and with respect to FIG. 5, advantageous aspects of the invention might be attainable by providing a ten-iron set of heads having only three different size total planar striking areas, as opposed to the ten different size areas as shown. Specifically and again by way of example only, the 2-iron head and the 3-iron head might each be manufactured to have the exact same size total hitting area, the #4, #5 and #6 be manufactured to each have another common smaller size total hitting area, and the #7, #8, #9 and pitching wedge be manufactured to each have yet another common further smaller size total hitting area. Other relationships might of course be possible, with the invention only being limited by the concluding claims.

In the broadest aspect of this disclosure, for at least two chosen pairs of heads within a set, the striking face total planar area of individual heads within each chosen pair will increase in size in going from the higher numbered head to the lower numbered head in the pair. Again by way of example only and not by way of limitation, a 2-iron head in accordance with the invention could be manufactured to have a larger total planar hitting face area than a 3-iron head and a 4-iron head within a #2, #3, #4 set of heads. Further suppose the 3-iron head and 4-iron head were manufactured to each have the same total hitting face area. In such instance, two such chosen pairs within the set would be the 2-iron/3-iron pair and the 2-iron/4-iron pair. In each such pair, the total planar area of the higher numbered head in each pair (the 3-iron or the 4-iron, respectively) increases in going to the lowered numbered head in the pair (the 2-iron in each pair) in that the 2-iron head is larger than each of the 3-iron head or 4-iron head. Such provides an example wherein two heads within at least one of the chosen pairs consists of heads consecutively numbered within the set. That pair would be the 2-iron/3-iron pair. Such further provides an example wherein at least two chosen pairs include a common head (the 2-iron head) from the set.

Now consider the 2-iron, 3-iron and 4-iron heads as shown in the FIG. 5 embodiment. Again by way of example only and not by way of limitation, example pairs within that set having the above broad properties would be the 2-iron head/3-iron head pair; the 2-iron head/4-iron head pair; and the 3-iron head/4-iron head pair. In such instance, for example, the 2-iron head/3-iron head pair and the 3-iron head/4-iron head pair each consists of heads consecutively numbered within the set. Further, such example provides two chosen pairs including a common head (the 3-iron head) from the set, with the two chosen pairs collectively defining a subset of correlated golf clubs having a total of three heads (the 2, 3 and 4), with the common head (the 3-iron head) being numbered between the other two heads (the 2-iron head and the 4-iron head) of the subset.

The above-described relationships are believed to be of most significance to the golfer in the longer hitting iron heads, comprising at least the three heads consecutively numbered 4 through 2. Advantages are, however, realized as provided above with other numbers of heads within the set or subset up to the greatest advantage being believed provided in the consecutive progressions of a 2-iron through at least a 10-iron (PW). Advantages would also be achieved in connection with a 1-iron head, and within non-consecutive subsets such as for example a starter 3, 5, 7 and 9-iron set.

In accordance with a further aspect of the invention, the invention contemplates providing an other than standard upward-angling of the sole relative to the hosel for the long irons. This will preferably mean that when the golfer addresses the ball with the long irons, the sole of the club will not lie flat with the ground. Rather, it will be angled upwardly away from the turf surface at the toe, with the heel of the sole resting on the ground. When the typical, banana-like, bowing action occurs as the golfer swings the long irons, a goal is to get/keep the toe out of the ground as the golfer swings through the ball. Ideally, the effect will be to present the golf club head at the ball with the heel and toe of the sole brushing in a parallel manner to and through the turf. Accordingly with this aspect of the invention, face and hosel angling relationships, at least with respect to the long irons, are different than the prior art to provide such effects.

For example in one aspect of this part of the invention, the 3-iron head, 4-iron head and 5-iron head comprise a correlated set of individually numbered golf irons. The hosel is provided relative to the sole to provide a different and increasing lie angle in sequentially progressing from the 3-iron head to the 5-iron head. Within such set, the sum of the differences between the lie angles in the 3-iron/4-iron pair and between the lie angles in the 4-iron/5-iron pair are less than or equal to about 1.0°. If a 2-iron head is included, preferably the sum of the differences between the lie angles in the 2-iron/3-iron pair, between the lie angles in the 3-iron/4-iron pair, and between the lie angles in the 4-iron/5-iron pair are less than or equal to a total of about 1.5°. Further, if a 6-iron head, a 7-iron head, and an 8-iron head are included, the difference between the lie angles of the 2-iron head and 8-iron head are less than or equal to about 3.5°, with less than or equal to about 3.0° being even more preferred. The difference between the lie angles of each of the 3-iron/4-iron and the 4-iron/5-iron pairs is equal to about 0.5°. Such relationships are evident in the preferred embodiment set from analyzing the lie angle data from the above respective Table 2.

Such a set has a sequentially progressive increasing lie angle between each consecutive pairs of irons within the set. Effectively, the lie angle of the short iron can remain similar to prior art configurations, while the lie angles in the longer irons do not decrease as much from the short irons as in the prior art, with the progression also being smaller than with the prior art. Accordingly, a typical and preferred lie angle of a 2-iron head will be about 60.5°, wherein a preferred lie angle for a 3-iron head in accordance with the invention will be about 61°.

Such a differing lie angle will result in the average golfer having a sole which is not parallel to the ground at typical address, with the toe being raised off the turf slightly. As the golfer swings the club, the bowing action of the longer irons will at a minimum keep the toe out of the ground, and most preferably present the toe and sole substantially parallel to the ground upon impact with the ball.

I claim:

1. A correlated set of individually numbered golf club irons progressing from a high numbered club to a low numbered club; the clubs numbering at least three within the set; individual clubs having a front striking face, a rear face, a sole, a toe, a heel and a hosel; the front striking faces of clubs within the set individually having a total planar area defining a progressively decreasing loft angle in going from the high numbered club to the low numbered club; the substantial rear face of the low numbered club within the set having an open cavity volume provided therein, higher numbered clubs within the set having a respective rear face with an open cavity volume which progressively decreases within the set in going from lower number clubs to higher number clubs.

2. The correlated set of individually numbered golf clubs of claim 1 wherein for at least two chosen pairs of clubs within the set, the striking face total planar area of individual clubs within each chosen pair increasing in size in going from the higher numbered club to the lower numbered club in the pair.

3. The correlated set of individually numbered golf clubs of claim 1 wherein the clubs number at least four within the set; and for at least two chosen pairs of clubs within the set, the striking face total planar area of individual clubs within each chosen pair increasing in size in going from the higher numbered club to the lower numbered club in the pair.

4. The correlated set of individually numbered golf clubs of claim 1 wherein the two clubs within at least one of the chosen pairs consist of clubs consecutively numbered within the set.

5. The correlated set of individually numbered golf clubs of claim 1 wherein the two clubs within each of the chosen pairs consist of clubs consecutively numbered within the set.

6. The correlated set of individually numbered golf clubs of claim 1 wherein the at least two chosen pairs include a common club from the set.

7. The correlated set of individually numbered golf clubs of claim 1 wherein said two chosen pairs include a common club from the set, said two chosen pairs collectively defining a subset of correlated golf clubs having a total of three clubs, the common club being numbered between the other two clubs of the subset.

8. The correlated set of individually numbered golf clubs of claim 1 wherein, the two clubs within at least one of the chosen pairs consist of clubs consecutively numbered within the set; and said two chosen pairs include a common club from the set, said two chosen pairs collectively defining a subset of correlated golf clubs having a total of three clubs, the common club being numbered between the other two clubs of the subset.

9. The correlated set of individually numbered golf clubs of claim 1 wherein, the two clubs within each of the chosen pairs consist of clubs consecutively numbered within the set; and said two chosen pairs include a common club from the set, said two chosen pairs collectively defining a subset of correlated golf clubs having a total of three clubs, the common club being numbered between the other two clubs of the subset.

10. The correlated set of individually numbered golf clubs of claim 1 wherein the clubs comprise at least three clubs consecutively numbered 4 through 2.

11. The correlated set of individually numbered golf clubs of claim 1 wherein the clubs comprise at least three clubs consecutively numbered 5 through 3.

12. The correlated set of individually numbered golf clubs of claim 1 wherein the clubs comprise at least four clubs consecutively numbered 5 through 2.

13. The correlated set of individually numbered golf clubs of claim 1 wherein the clubs comprise at least three clubs numbered 2, 5, and 8.

14. The correlated set of individually numbered golf clubs of claim 1 wherein the clubs comprise at least three clubs numbered 3, 5, and 7.

15. The correlated set of individually numbered golf clubs of claim 1 wherein the front striking faces of clubs within the set individually having a maximum planar length, for the at least two chosen pairs of clubs within the set, the maximum planar length of individual clubs within each chosen pair increasing in size in going from the higher numbered club to the lower numbered club.

16. The correlated set of individually numbered golf clubs of claim 1 wherein the front striking faces of clubs within the set individually having a maximum planar height, for the at least two chosen pairs of clubs within the set, the maximum planar height of individual clubs within each chosen pair increasing in size in going from the higher numbered club to the lower numbered club.

17. The correlated set of individually numbered golf clubs of claim 1 wherein, the front striking faces of clubs within the set individually having a maximum planar length, for the at least two chosen pairs of clubs within the set, the maximum planar length of individual clubs within each chosen pair increasing in size in going from the higher numbered club to the lower numbered club; and the front striking faces of clubs within the set individually having a maximum planar height, for the at least two chosen pairs of clubs within the set, the maximum planar height of individual clubs within each chosen pair increasing in size in going from the higher numbered club to the lower numbered club.

18. The correlated set of individually numbered golf clubs of claim 1 wherein all clubs within the set consecutively progress from a high numbered club to a low numbered club, the striking face total planar area of individual clubs progressively increasing in size in going consecutively from the high numbered club to the low numbered club within the set.

19. The correlated set of individually numbered golf clubs of claim 1 wherein individual clubs have a front striking face with scoring lines thereon; the front striking faces of clubs within the set individually having a planar scoring line area defined by a toe-side scoring line terminus and a heel-side scoring line terminus; for the at least two chosen pairs of clubs within the set, the planar scoring line area of individual clubs within each chosen pair increasing in size in going from the higher numbered club to the lower numbered club in the pair.

20. The correlated set of individually numbered golf clubs of claim 1 wherein, the clubs comprise at least three clubs numbered 3, 5, and 7; and the front striking faces of clubs within the set individually having a maximum planar length, for the at least two chosen pairs of clubs within the set, the maximum planar length of individual clubs within each chosen pair increasing in size in going from the higher numbered club to the lower numbered club.

21. The correlated set of individually numbered golf clubs of claim 1 wherein, the clubs comprise at least three clubs numbered 3, 5, and 7; and the front striking faces of clubs within the set individually having a maximum planar height, for the at least two chosen pairs of clubs within the set, the maximum planar height of individual clubs within each chosen pair increasing in size in going from the higher numbered club to the lower numbered club.

22. The correlated set of individually numbered golf clubs of claim 1 wherein, the clubs comprise at least three clubs numbered 3, 5, and 7; and the front striking faces of clubs within the set individually having a maximum planar length, for the at least two chosen pairs of clubs within the set, the maximum planar length of individual clubs within each chosen pair increasing in size in going from the higher numbered club to the lower numbered club; and the front striking faces of clubs within the set individually having a maximum planar height, for the at least two chosen pairs of clubs within the set, the maximum planar height of individual clubs within each chosen pair increasing in size in going from the higher numbered club to the lower numbered club.

23. The correlated set of individually numbered golf clubs of claim 1 wherein, the clubs comprise at least three clubs numbered 3, 5, and 7; and individual clubs have a front striking face with scoring lines thereon; the front striking faces of clubs within the set individually having a planar scoring line area defined by a toe-side scoring line terminus and a heel-side scoring line terminus; for the at least two chosen pairs of clubs within the set, the planar scoring line area of individual clubs within each chosen pair increasing in size in going from the higher numbered club to the lower numbered club in the pair.

* * * * *

UNITED STATES PATENT AND TRADEMARK OFFICE

CERTIFICATE OF CORRECTION

PATENT NO. : 5,665,009
DATED : September 9, 1997
INVENTOR(S) : Brad L. Sherwood

It is certified that error appears in the above-identified patent and that said Letters Patent is hereby corrected as shown below:

In Column 1, line 7, delete "US90/01864" and insert --US95/01864--.

Signed and Sealed this

Thirteenth Day of October 1998

*Attest:*

Bruce Lehman

BRUCE LEHMAN

*Attesting Officer*

*Commissioner of Patents and Trademarks*